US010991521B2

(12) United States Patent
Pan et al.

(10) Patent No.: US 10,991,521 B2
(45) Date of Patent: Apr. 27, 2021

(54) LOCKING DEVICE FOR CIRCUIT BREAKER OPERATION DEVICE

(71) Applicant: ShangHai Liangxin Electrical Co., Ltd, Shanghai (CN)

(72) Inventors: Wanjun Pan, Shanghai (CN); Yanqun Yang, Shanghai (CN)

(73) Assignee: ShangHai Liangxin Electrical Co., Ltd, Shanghai (CN)

( * ) Notice: Subject to any disclaimer, the term of this patent is extended or adjusted under 35 U.S.C. 154(b) by 0 days.

(21) Appl. No.: 16/758,083

(22) PCT Filed: Oct. 17, 2018

(86) PCT No.: PCT/CN2018/110713

§ 371 (c)(1),
(2) Date: Apr. 22, 2020

(87) PCT Pub. No.: WO2019/080760

PCT Pub. Date: May 2, 2019

(65) Prior Publication Data

US 2020/0279699 A1 Sep. 3, 2020

(30) Foreign Application Priority Data

Oct. 26, 2017 (CN) ..... 201711022046.3

(51) Int. Cl.
*H01H 9/24* (2006.01)
*H01H 71/02* (2006.01)
*H01H 71/10* (2006.01)

(52) U.S. Cl.
CPC ..... *H01H 9/24* (2013.01); *H01H 71/0214* (2013.01); *H01H 71/1009* (2013.01)

(58) Field of Classification Search
CPC ... H01H 9/24; H01H 71/0214; H01H 71/1009
(Continued)

(56) References Cited

U.S. PATENT DOCUMENTS 5,575,381 A 11/1996 Castonguay et al.

FOREIGN PATENT DOCUMENTS

CN 201975350 9/2011
CN 202018931 * 10/2011 ..... H01H 71/02
(Continued)

OTHER PUBLICATIONS

International Search Report and Written Opinion from PCT/CN2018/110713 dated Dec. 14, 2018.
English Translation of Chinese Abstracts.

*Primary Examiner* — Edwin A. Leon
*Assistant Examiner* — Iman Malakooti
(74) *Attorney, Agent, or Firm* — Hogan Lovells US LLP

(57) ABSTRACT

A locking mechanism for a circuit breaker operation device includes a housing (1). A button (2) is mounted in a button slot (101) of the housing (1). The locking mechanism is characterized in that the housing (1) is provided with a locking member (3) therein, and the locking member (3) can lock or unlock the button (2). In the locking mechanism for a circuit breaker operation device, a locking member is added in the circuit breaker; only after a lock button is pressed, an operation button is pressed to close the circuit breaker; when the operation button is pulled out, the circuit breaker is disconnected; when the lock button is not pressed, the operation button is locked by the lock button, the operation button cannot be pressed down, the circuit breaker cannot be closed.

4 Claims, 4 Drawing Sheets

(58) Field of Classification Search
USPC ..... 200/50.01
See application file for complete search history.

(56) References Cited

FOREIGN PATENT DOCUMENTS

| | | |
|---|---|---|
| CN | 204885044 | 12/2015 |
| CN | 107833804 | 3/2018 |
| CN | 207624641 | 7/2018 |

* cited by examiner

LOCKING DEVICE FOR CIRCUIT BREAKER OPERATION DEVICE

TECHNICAL FIELD

The present disclosure pertains to the technical field of circuit breakers, and in particular relates to a locking device for a circuit breaker operating device (a locking device for circuit breaker operation device).

BACKGROUND ART

Circuit breakers are divided into high-voltage circuit breakers and low-voltage circuit breakers according to their scopes of use. The low-voltage circuit breaker is also referred to as an automatic switch, which is an electrical appliance that acts as a manual switch and can also automatically perform voltage-loss, under-voltage, overload, and short-circuit protection. It can be used for distribution of electrical energy, infrequent starting of an asynchronous motor, and protection of power circuit, motor, and the like. Circuits can be automatically cut off when they have severe failures such as overload or short-circuit and under-voltage failures. The circuit breaker functions equivalently to a combination of fuse switch and over-heat or under-heat relay or the like, and it is generally unnecessary to change parts or components after the failure current is interrupted, therefore the circuit breakers have been widely used.

Circuit breakers are divided into a plug-in type, a fixed type, and a drawer type according to installation modes. The plug-in type circuit breakers can be used for effectively improving the safety in the industries where electrical equipment is used. As the plug-in type circuit breakers are widely used in various electrical equipment, the plug-in type circuit breakers have been developed to have various structures in order to meet the requirements for installation in various different electrical equipment. In the arrangements of currently existing traditional plug-in type circuit breaker products at installation positions, in general, the circuit breaker is closed by pressing an operation button, the operation button of the circuit breaker is resiliently restored to its initial position upon the operating force is removed, and the circuit breaker is disconnected when the button is pressed again. In this traditional installation mode, the circuit breaker can be switched on by pressing the operation button despite whether the circuit breaker has been installed in a cabinet. When a circuit breaker is plugged into the cabinet in a state where the circuit breaker has been connected with wires and the circuit breaker has been closed, a small electric arc will be generated between a wiring terminal of the circuit breaker and a busbar, which may endanger the safety of neighboring equipment.

SUMMARY

An object of the present disclosure is to solve the technical problem in the prior art that when a circuit breaker is plugged into the cabinet in a state where the circuit breaker has been connected with wires and the circuit breaker has been closed, a small electric arc will be generated between a wiring terminal of the circuit breaker and a busbar, which may endanger the safety of neighboring equipment. A locking mechanism for a circuit breaker operating device is provided, wherein a locking member is added inside the circuit breaker, so that the circuit breaker can be closed by pressing an operation button only after a first lock button is depressed, and the circuit breaker is disconnected when the operation button is pulled out; when the first lock button is not depressed, the operation button is locked by the first lock button, the operation button cannot be pressed, and thus the circuit breaker cannot be closed. No electric arc is generated between a wiring terminal of the circuit breaker and a busbar, and accordingly the safety of the equipment is ensured.

TECHNICAL SOLUTION

In order to achieve the above technical objective, a locking mechanism for a circuit breaker operating device is designed in the present disclosure, which comprises a housing, a button mounted in a button slot of the housing, wherein the housing is provided therein with a locking member, and the locking member can lock or unlock the button.

Further, the locking member includes a first lock button, the first lock button is mounted to an inner wall of the housing via a first shaft and is rotatable about the first shaft, a first limiting boss is provided at a left end of the first lock button, the button is provided with a first limiting step corresponding to the first limiting boss, a first locking boss is provided on a right upper end surface of the first lock button, the housing is provided with a first limiting slot hole corresponding to the first locking boss, a first torsion spring is mounted to the housing, and one end of the first torsion spring rests on a lower surface of the first lock button located on a right side of the first shaft.

Further, a groove is provided on the lower surface of the first lock button located on the right side of the first shaft, a barb boss corresponding to the groove is provided on an outer side surface of the first lock button, and the one end of the first torsion spring rests in the groove and abuts against the barb boss.

Further, the locking member includes a second lock button, the second lock button is mounted to an inner wall of the housing via a second shaft and is rotatable about the second shaft, a limiting lever extends from a right side of the second lock button, a handle is provided with a second limiting step corresponding to the limiting lever, the handle is mounted to the inner wall of the housing via a third shaft and is rotatable about the third shaft, the button is connected to the handle via a connecting rod, a second locking boss is provided at a left upper end of the second lock button, the housing is provided with a second limiting slot hole corresponding to the second locking boss, a second torsion spring is mounted to the housing, and the second torsion spring has one end resting on a lower surface of the second lock button located on a left side of the second shaft.

Preferably, the connecting rod is a U-shaped connecting rod.

Advantageous Effect

In a locking mechanism for a circuit breaker operating device according to the present disclosure, a locking member is added in the circuit breaker, so that the circuit breaker can be closed by pressing an operation button only after a first lock button is depressed, and the circuit breaker is disconnected when the operation button is pulled out; when the first lock button is not depressed, the operation button is locked by the first lock button, the operation button cannot be pressed, and thus the circuit breaker cannot be closed. No electric arc is generated between a wiring terminal of the circuit breaker and a busbar, and accordingly the safety of the equipment is ensured.

DETAILED DESCRIPTION OF EMBODIMENTS

The present disclosure is further described below with reference to the accompanying drawings and embodiments.

A locking mechanism for a circuit breaker operating device comprises a housing 1, a button 2 mounted in a button slot 101 of the housing 1. The housing 1 is provided therein with a locking member 3, and the locking member 3 can lock or unlock the button 2.

First Embodiment

Figure 1:
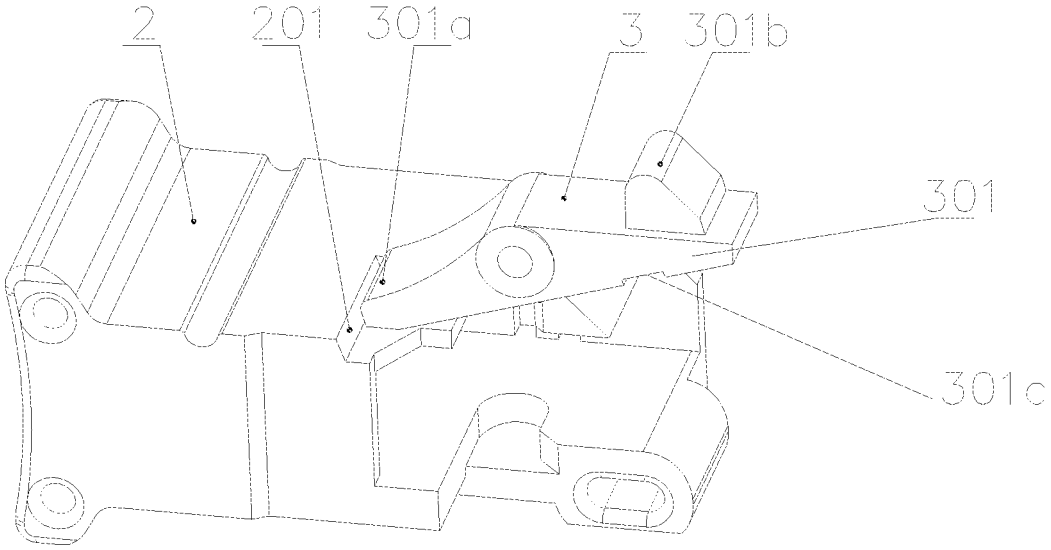
FIG. 1 is a schematic structural view of a first embodiment of the present disclosure.
Figure 2:
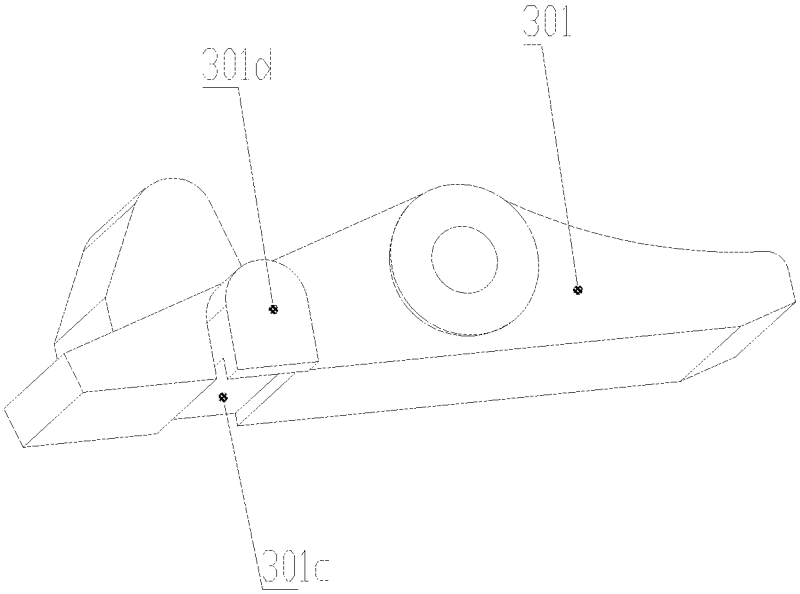
FIG. 2 is a schematic structural view of a first lock button in the first embodiment of the present disclosure.
Figure 4:
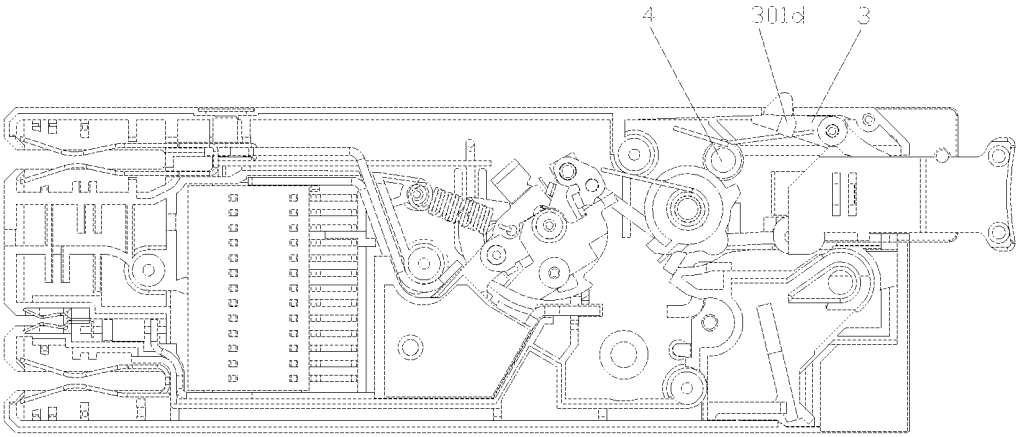
FIG. 4 is a schematic structural view showing the position of mounting of a first torsion spring in the first embodiment of the present disclosure.

In a specific embodiment of the present disclosure, as shown in FIGS. 1 and 2, the locking member 3 includes a first lock button 301, the first lock button 301 is mounted to an inner wall of the housing 1 via a first shaft 302 and is rotatable about the first shaft 302, a left end of the first lock button 301 is provided with a first limiting boss (or protrusion) 301*a*, the button 2 is provided with a first limiting step 201 corresponding to the first limiting boss 301*a*, a first locking boss 301*b* is provided on a right upper end surface of the first lock button 301, and the housing 1 is provided with a first limiting slot hole 102 corresponding to the first locking boss 301*b*. As shown in FIG. 4, a first torsion spring 4 is mounted to the housing 1, one end of the first torsion spring 4 rests on the housing 1, a groove 301*c* is provided on a lower surface of the first lock button 301 located on a right side of the first shaft 302, a barb boss 301*d* corresponding to the groove 301*c* is provided on an outer side surface of the first lock button 301, and the other end of the first torsion spring 4 rests in the groove 301*c* and abuts against the barb boss 301*d*.

Figure 3:
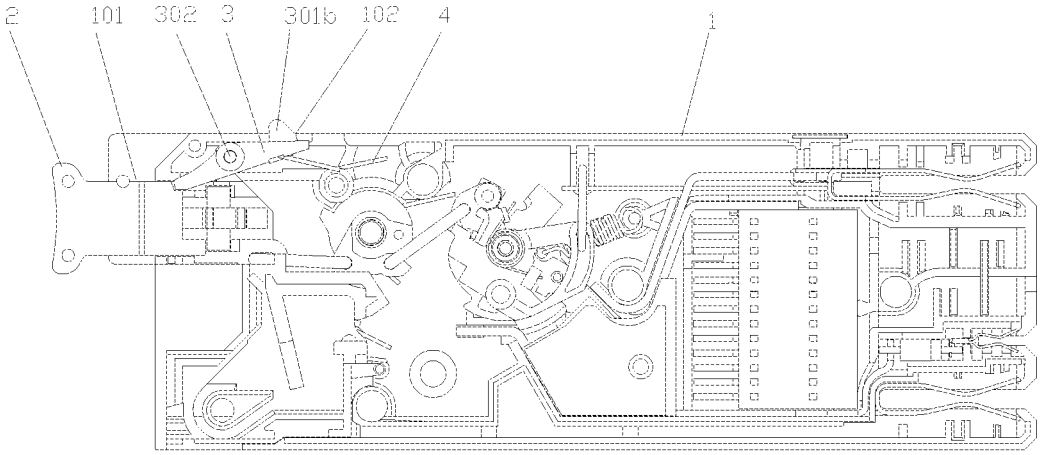
FIG. 3 is a schematic structural view of the first lock button in a free state in the first embodiment of the present disclosure.

As shown in FIG. 3, the circuit breaker is in a disconnected state. The first lock button 301 is subjected to the action of the first torsion spring 4 so that the first limiting boss 301*a* on the left side of the first lock button 301 abuts against the first limiting step 201 of the button 2, the button 2 is locked by the first lock button 301, the operation button 2 cannot be pressed, and thus the circuit breaker cannot be switched on.

Figure 5:
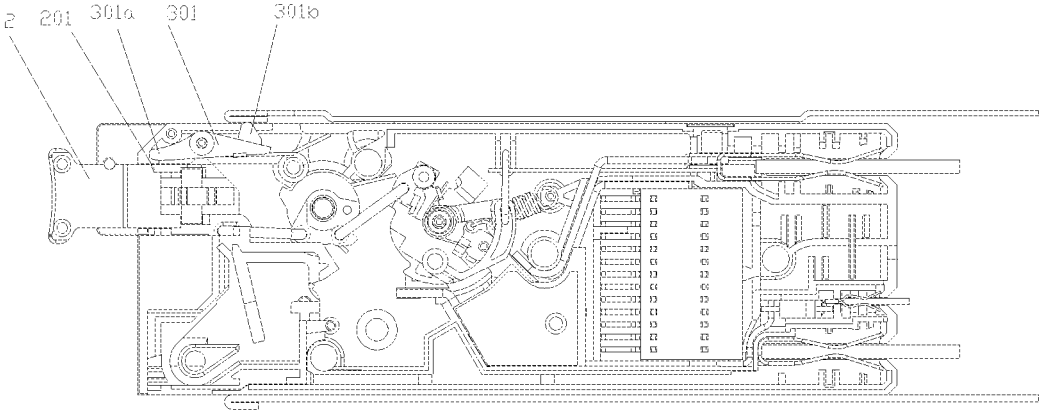
FIG. 5 is a schematic structural view of a circuit breaker plugged into a cabinet in the first embodiment of the present disclosure.

As shown in FIG. 5, the circuit breaker is in a freely openable or closable state. When the circuit breaker is installed in place in the cabinet, the first locking boss 301*b* on the right side of the first lock button 301 is depressed by the cabinet plate, the first lock button 301 rotates clockwise, the first limiting boss 301*a* on the left side of the first lock button 301 no longer abuts against the first limiting step 201 in the middle of the button 2, and thus the operation button 2 is unlocked. When the button 2 is pushed (or pulled), a connecting rod in the circuit breaker mechanism is driven to move so that the circuit breaker is closed (or opened).

Second Embodiment

Figure 6:
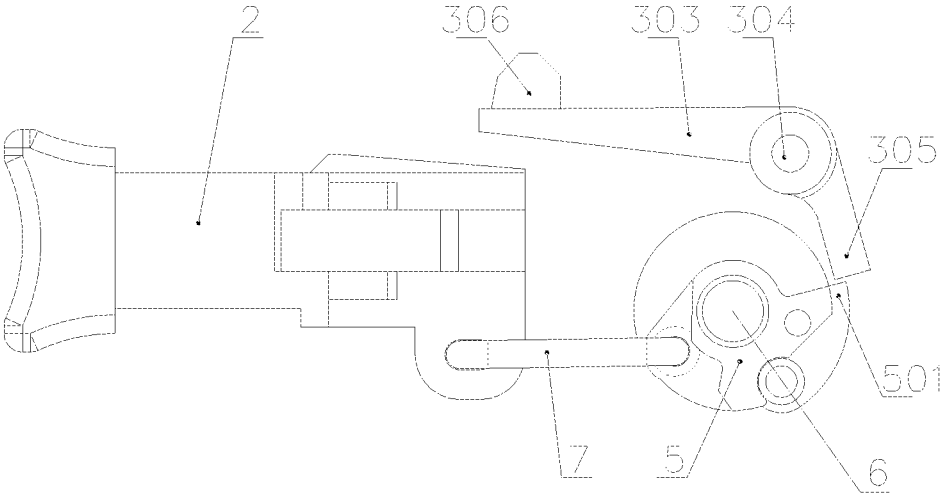
FIG. 6 is a schematic structural view of a second embodiment of the present disclosure.

In another specific embodiment of the present disclosure, as shown in FIG. 6, the locking member 3 includes a second lock button 303, the second lock button 303 is mounted to an inner wall of the housing 1 via a second shaft 304 and is rotatable about the second shaft 304, a limiting lever 305 extends from a right side of the second lock button 303, a handle 5 is provided with a second limiting step 501 corresponding to the limiting lever 305, the handle 5 is mounted to the inner wall of the housing 1 via a third shaft 6 and is rotatable about the third shaft 6, the button 2 is connected to the handle 5 via a U-shaped connecting rod 7, a second locking boss 306 is provided at a left upper end of the second lock button 303, the housing 1 is provided with a second limiting slot hole 103 corresponding to the second locking boss 306, a second torsion spring 8 is mounted to the second shaft 304, and the second torsion spring 8 has one end resting on the housing 1, and the other end resting on a lower surface of the second lock button 303 located on a left side of the second shaft 304.

Figure 7:
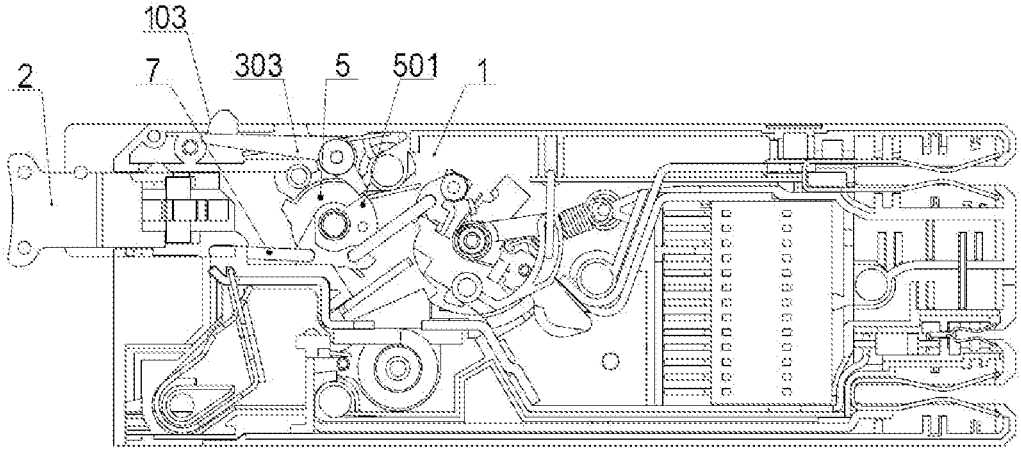
FIG. 7 is a schematic structural view of a second lock button in a free state in the second embodiment of the present disclosure.
Figure 8:
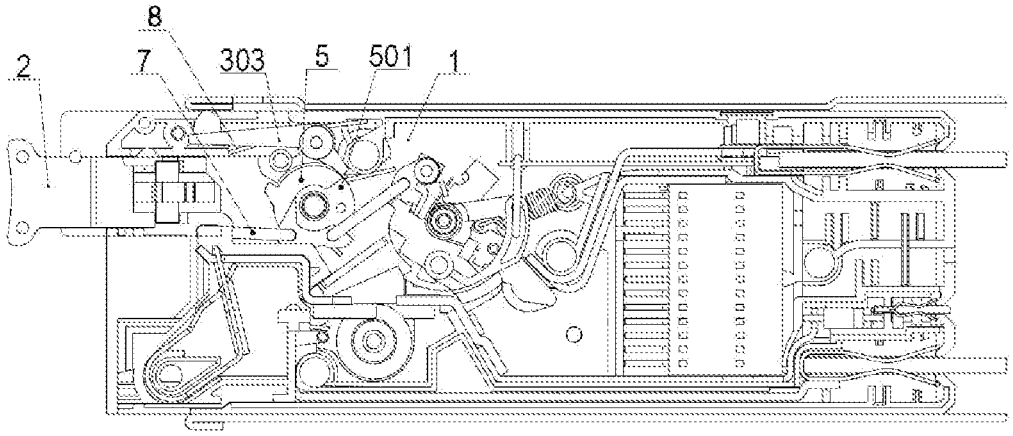
FIG. 8 is a schematic structural view of a circuit breaker plugged into a cabinet in the second embodiment of the present disclosure.

As shown in FIG. 7, when the circuit breaker is not installed in the cabinet, if the button 2 is pushed to move rightward, the handle 5 should be rotated counterclockwise by means of the connection with the U-shaped connecting rod 7. However, since the second locking boss 306 on the left side of the second lock button 303 is not depressed by the cabinet plate, the second lock button 303 is kept immovable under the action of the second torsion spring 8, the limiting lever 305 on the right side of the second lock button 303 abuts against the second limiting step 501 of the handle 5, and thus the handle 5 cannot be rotated. As shown in FIG. 8, after the circuit breaker is installed in the cabinet, the second locking boss 306 on the left side of the second lock button 303 is depressed by the cabinet plate, the second lock button 303 rotates counterclockwise against a reacting force from the second torsion spring 8, and thus the limiting lever 305 on the right side of the second lock button 303 no longer abuts against the second limiting step 501 of the handle 5. When the button 2 is pushed to move rightward, the handle 5 is rotated counterclockwise by means of the connection with the U-shaped connecting rod 7, and the circuit breaker can be operated to be opened and closed.

The structures, proportions, sizes, quantities, and the like depicted in the drawings appended to the embodiments are only used to cooperate the contents disclosed in the specification, to facilitate understanding and reading by those skilled in the art, and are not intended to limit restrictive conditions where the present disclosure is implementable, and therefore do not have a technically essential meaning. Any modification in structure, change in proportion relationship, or adjustment in size, without affecting the efficacy that can be generated by the present disclosure and the object that can be achieved by the present disclosure, should fall within the scope that can be covered by the technical content disclosed in the present disclosure. Moreover, terms such as "upper", "lower", "left", "right", "middle", "clockwise", "counterclockwise", and the like cited in this specification are also only intended to facilitate clear description, but are not intended to limit the scope where the present disclosure is implementable, and a change or adjustment in a relative relationship thereof, without essentially changing the technical content, should also be considered as falling within the scope where the present disclosure is implementable.

What is claimed is:

1. A locking mechanism for a circuit breaker operating device, comprising a housing, and a button mounted in a button slot of the housing, wherein the housing is provided therein with a locking member, and the locking member is configured for locking or unlocking the button, wherein the locking member comprises a first lock button, wherein the first lock button is mounted in the housing via a first shaft and is rotatable about the first shaft, a first limiting boss is provided on one side of the first lock button, the button is provided with a first limiting step corresponding to the first limiting boss, a first locking boss is provided on an upper surface on an other side of the first lock button, the housing is provided with a first limiting slot hole corresponding to the first locking boss, a first torsion spring is mounted to the housing, and the first torsion spring has one end resting on a lower surface of the first lock button located on a right side of the first shaft.

2. The locking mechanism for a circuit breaker operating device according to claim 1, wherein a groove is provided on the lower surface of the first lock button located on the right side of the first shaft, a barb boss corresponding to the groove is provided on an outer side surface of the first lock button, and the first torsion spring has one end resting in the groove and abuts against the barb boss.

3. A locking mechanism for a circuit breaker operating device, comprising a housing, and a button mounted in a button slot of the housing, wherein the housing is provided therein with a locking member, and the locking member is configured for locking or unlocking the button wherein the locking member comprises a lock button, the lock button is mounted in the housing via a first shaft and is rotatable about the first shaft, a limiting lever extends from one side of the lock button, a handle is provided with a limiting step corresponding to the limiting lever, the handle is mounted in the housing via a second shaft and is rotatable about the second shaft, the button is connected to the handle via a connecting rod, a locking boss is provided at an upper end on the other side of the lock button, the housing is provided with a limiting slot hole corresponding to the locking boss, a torsion spring is mounted to the housing, and the torsion spring has one end resting on a lower surface of the lock button located on a left side of the first shaft.

4. The locking mechanism for a circuit breaker operating device according to claim 3, wherein the connecting rod is a U-shaped connecting rod.

* * * * *